United States Patent [19]

Naito

[11] 4,363,297

[45] Dec. 14, 1982

[54] IGNITION TIMING CONTROL DEVICE FOR INTERNAL COMBUSTION ENGINE

[75] Inventor: Hiroyasu Naito, Sayama, Japan

[73] Assignee: Honda Giken Kogyo Kabushiki Kaisha, Tokyo, Japan

[21] Appl. No.: 178,084

[22] Filed: Aug. 14, 1980

Related U.S. Application Data

[63] Continuation of Ser. No. 5,331, Jan. 22, 1979, abandoned.

[30] Foreign Application Priority Data

Feb. 3, 1978 [JP] Japan ..... 53-12517

[51] Int. Cl.[3] ..... F02P 5/04

[52] U.S. Cl. ..... 123/146.5 A; 123/420; 200/31 CA; 464/6

[58] Field of Search ..... 123/146.5 A, 420; 64/25; 200/31 CA

[56] References Cited

U.S. PATENT DOCUMENTS

| | | | |
|---|---|---|---|
| 660,338 | 10/1900 | Rogers | 200/31 CA |
| 3,715,528 | 2/1973 | Habert | 200/31 CA |
| 3,776,205 | 12/1973 | Maruoka | 123/420 |
| 3,776,211 | 12/1973 | Droke et al. | 123/420 |
| 3,964,456 | 6/1976 | Eshelman | 123/420 |

FOREIGN PATENT DOCUMENTS

| | | | |
|---|---|---|---|
| 41-27929 | 10/1966 | Japan | 200/31 CA |
| 1230907 | 5/1971 | United Kingdom | 123/420 |

*Primary Examiner*—P. S. Lall

*Attorney, Agent, or Firm*—Lyon & Lyon

[57] ABSTRACT

Ignition timing of an internal combustion engine is caused to advance in stepped increments as the engine speed increases in a uniform manner. Centrifugal weights of different sizes move a timing control element by angular increments against the action of a spring. The movement is with respect to a rotary member turning in timed relation with the crankshaft of the engine.

3 Claims, 6 Drawing Figures

IGNITION TIMING CONTROL DEVICE FOR INTERNAL COMBUSTION ENGINE

This application is a continuation application of my earlier filed U.S. application Ser. No. 5,331, filed Jan. 22, 1979, now abandoned. This invention relates to internal combustion engines and is particularly directed to an improved ignition timing control device which causes the ignition timing to be advanced in steps. By this means the engine is prevented from knocking at low speeds and the spark is advanced to obtain high power output at high speeds. Moreover, spark advance characteristics matching the engine requirements are provided.

It is known to adjust the ignition timing in accordance with changes in the speed of the engine in such a manner that the ignition timing is retarded at low speeds and is advanced at high speeds. However, in conventional spark advance devices of this kind, a weight operated by centrifugal force is moved outward as rotation of the crankshaft increases. This turns a timing control element in the direction of the shaft rotation for advancing the ignition timing, and as the shaft rotation decreases, causes the timing control element to turn in the opposite direction to the shaft rotation by force of a spring to retard the ignition timing. However, in such prior art devices, any weight for actuating the timing control element is of the same one kind, even when a plurality of weights are provided. Consequently, advance of the spark is small when the engine is idling, and when a certain engine speed is reached the spark is abruptly advanced by operation of the centrifugal weight, and for higher engine speeds no change takes place in the spark advance. The advance during a transfer from low engine speed to high engine speed is abrupt and large. The result is that there is a range of relatively low speeds greater than idling in which the engine develops knocking. In order to prevent such knocking, it is possible to employ leaded fuel, but such leaded fuel is not desirable. The single, large and abrupt change in ignition timing is all that prior art devices of this type provide.

In accordance with this invention a spark advancer is provided in which a plurality of sequentially operable centrifugal weights provide a plurality of stepped increments in spark advance as the engine speed increases. A weight is actuated centrifugally at a specified engine speed to cause a first spark advance, and after a specified further increase in engine speed another weight is actuated centrifugally to produce another spark advance. Additional steps in the spark advance pattern can be obtained by employing additional weights.

Other and more detailed objects and advantages will appear hereinafter.

In the drawings

Figure 1:
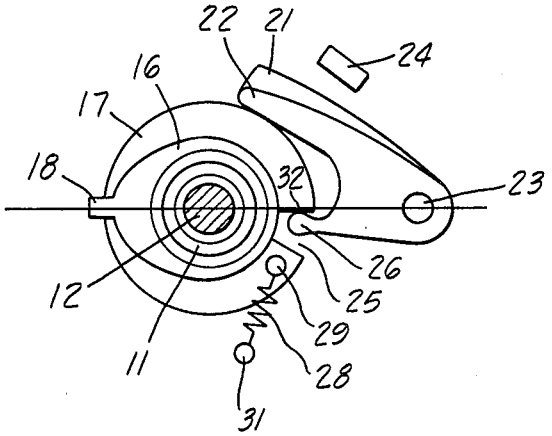
FIG. 1 is a front sectional view showing a preferred embodiment of this invention.
Figure 3:
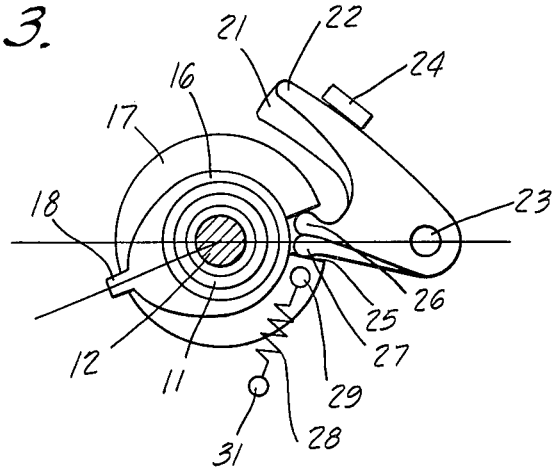

FIG. 3. is a view similar to FIG. 1 showing the parts in a third position.

Figure 4:
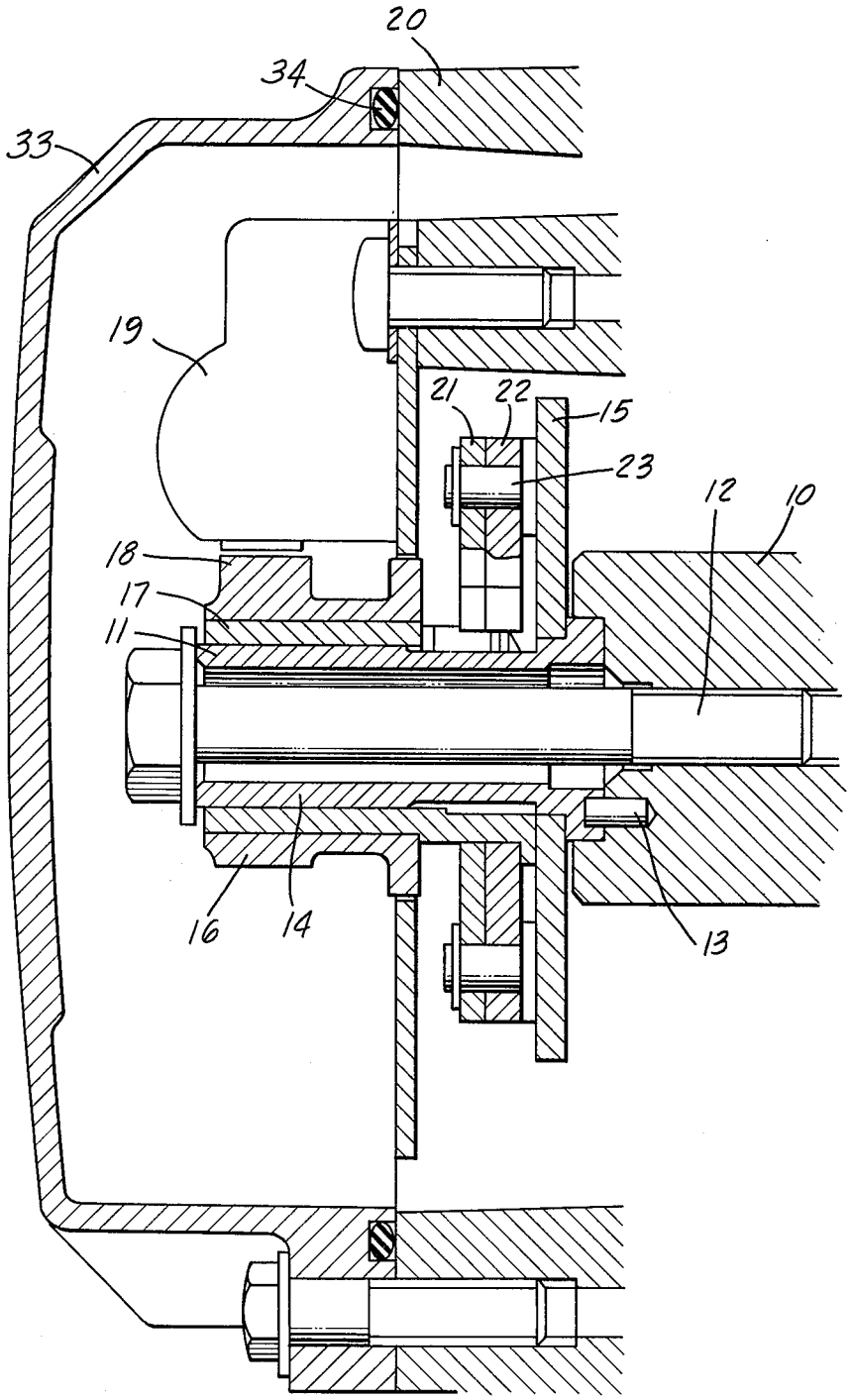

FIG. 4 is a sectional side elevation partly broken away.

Figure 5:
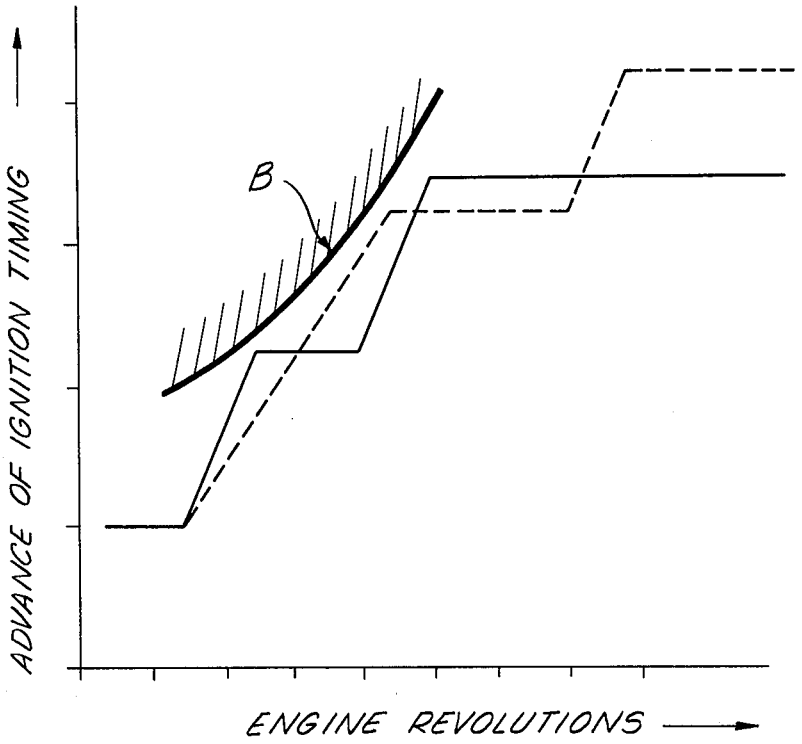

FIG. 5 is a graph showing the relationship of spark advance increments for increasing engine revolutions, in accordance with this invention.

Figure 6:
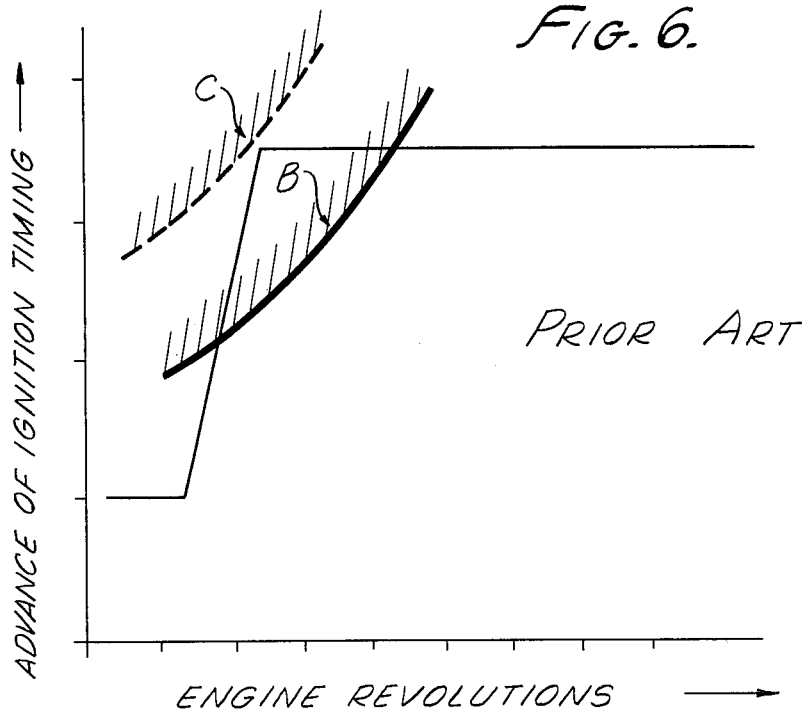

FIG. 6 is a graph similar to FIG. 5 showing the relationship of ignition timing with respect to engine revolutions for prior art devices.

Referring to the drawings, a drive means which may be the engine crankshaft 10, or other shaft driven in timed relation with the crankshaft, is connected to a rotary member 11 by means of a coaxial bolt 12 and an alignment pin 13. The rotary member 11 has a hub portion 14 and a flange portion 15 integrally connected for operation as a unit.

A timing control element or sleeve 16 has a tubular part 17 fixed therein and mounted to turn on the hub portion 14 of the rotary member 11. The timing control element 16 has a lateral projection 18 at one side which serves as a pulse pickup device as it passes the stationary pulse generator 19. It will be understood that this pulse generator 19 controls the timing of the engine ignition system in a conventional manner. A stationary case 20 and a stationary cover 33 form an enclosure for the device, and a resilient seal ring 34 between the case 20 and the cover 33 serves to prevent leakage of engine oil from within the cover 33.

In accordance with this invention, a plurality of centrifugally operated weights 21 and 22 are mounted on a common pivot pin 23 carried on the flange portion 15 of the rotary member 11. The weights 21 and 22 are of different sizes, the weight 21 being heavier. Movement of the weights under centrifugal force is limited by the abutment 24, also carried on the flange 15. While only two weights are shown, it will be understood that more than two weights may be employed if desired. Separate abutments, one for each weight, may be provided if desired.

Figure 2:
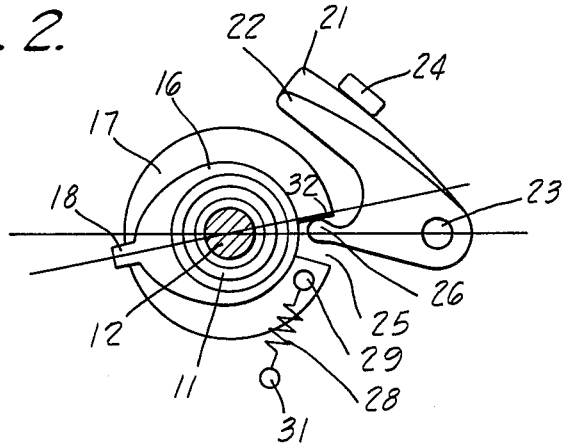
FIG. 2 is a view similar to FIG. 1 showing the parts in a second position.

The bearing sleeve portion 17 of the timing control sleeve 16 has a notch 25 in its periphery. The weight 22 has a rounded finger 26 projecting into the slot 25, and the weight 21 has a similar rounded finger 27 projecting into the same slot 25. A tension spring 28 extends between a pin 29 on the flange 17 and a pin 31 on the flange portion 15 of the rotary member 11. The function of the spring 28 is to turn the timing control sleeve 16 with respect to the rotary member 11 in a clockwise direction, as shown in FIGS. 1, 2 and 3.

In operation, the timing control parts remain in the relative positions shown in FIG. 1 so long as the engine is idling. When the engine speed has increased to a predetermined value, the heavier weight 21 swings about its pivot 23 by centrifugal force until it contacts the abutment 24. This movement of the weight 21 causes its rounded finger 27 to move against the forward side 32 of the notch 25, thereby moving the timing control sleeve 16 in a counterclockwise direction against the action of the spring 28 to the position shown in FIG. 2. The rounded finger 26 of the lighter weight 22 remains in contact with the side 32 of the notch 25. A further increase in engine speed beyond a predetermined maximum causes the lighter weight 22 to swing outward by centrifugal force into contact with the abutment 24. The rounded finger 26 engages the side 32 of the notch 25 to cause further angular movement of the timing control sleeve 16 in a counterclockwise direction against the action of the spring 28 to the position shown in FIG. 3.

It will be observed that the timing control member 16 is moved by stepped increments as the engine speed increases in a uniform manner. This operating characteristic is clearly shown in the graph of FIG. 5. The size of the weights and geometry of the parts are chosen so that the ignition timing is advanced by predetermined increments so that the region of engine knocking as shown by the line "B" is avoided. This is to be contrasted with the graph of FIG. 6 showing prior art devices in which the ignition timing advance has only one step which may of necessity invade the region "B" in which engine knocking occurs. While it may be possible to avoid engine knocking by employing leaded fuel so that the knocking region is shown by the line "C", leaded fuel is not desirable for vehicles in which exhaust purification is required.

Having fully described my invention, it is to be understood that I am not to be limited to the details herein set forth but that my invention is of the full scope of the appended claims.

I claim:

1. In an internal combustion engine, an ignition timing comtrol device comprising in combination a stationary pulse generator, a rotary member, a drive means coupled with said rotary member for rotation in timed relation with the engine crankshaft, a timing control element pivotally mounted coaxially on said rotary member, said stationary pulse generator being proximal to said timing control element, a first pivot pin fixed to said rotary member and aligned parallel to the axis of said rotary member, a plurality of eccentric weights pivotally ahd eccentrically mounted to said first pivot pin, each of said eccentric weights having a finger projecting to said timing control element for coupling therewith to pivot said element relative to said rotary member with pivotal movement of each said eccentric weight, said eccentric weights being of different effective weight one from another, a stop fixed to said rotary member and positioned to interfere with the pivotal movement of said eccentric weights, each said weight being allowed by said stop to pivotally move a distance relative to each other said weight by inverse relation to its effective weight, and spring means acting between said rotary member and said timing control element to resist pivotal movement of said timing control element resulting from movement of said eccentric weights.

2. The ignition control timing device of claim 1 wherein said plurality of weights includes a first eccentric weight and a second eccentric weight, said first eccentric weight being heavier then said second eccentric weight, said second eccentric weight being allowed greater pivotal movement than said first eccentric weight by said stop.

3. In an internal combustion engine, an ignition timing control device comprising in combination a sealed stationary case defining a chamber therein, a pulse generator fixed relative to said stationary case, a rotary member contained within said chamber, a drive means coupled with said rotary member for rotation in timed relation with the engine crankshaft, a timing control element pivotally mounted coaxially on said rotary member, said pulse generator being proximal to said timing control element, a first pivot pin fixed to said rotary member and aligned parallel to the axis of said rotary member, a first eccentric weight pivotally and eccentrically mounted to said first pivot pin and having a first finger projecting to said timing control element for coupling therewith, pivotal movement of said first eccentric weight resulting in movement of said timing control element relative to said rotary member, a second eccentric weight pivotally and eccentrically mounted to said first pivot pin and having a second finger projecting to said timing control element for coupling therewith, pivotal movement of said second weight resulting in movement of said timing control element relative to said rotary member, a stop fixed to said rotary member and positioned to interfere with the pivotal movement of said first eccentric weight and said second eccentric weight, said second eccentric weight being allowed greater pivotal movement than said first eccentric weight by said stop, and spring means acting between said rotary member and said timing control element to resist pivotal movement of said timing control element resulting from movement of said eccentric weights.

* * * * *